US005275846A

United States Patent [19]

Imai et al.

[11] Patent Number: 5,275,846

[45] Date of Patent: Jan. 4, 1994

[54] METHOD OF PRODUCING A CAST COATED PAPER

[75] Inventors: Tetsuro Imai; Junichi Miyake; Kazuhiro Nojima, all of Amagasaki, Japan

[73] Assignee: Kanzaki Paper Mfg. Co., Ltd., Tokyo, Japan

[21] Appl. No.: 917,852

[22] Filed: Jul. 21, 1992

[30] Foreign Application Priority Data

Jul. 24, 1991 [JP] Japan ..... 3-184450
Aug. 29, 1991 [JP] Japan ..... 3-218889
Sep. 2, 1991 [JP] Japan ..... 3-221818

[51] Int. Cl.[5] ..... B05D 3/12
[52] U.S. Cl. ..... 427/362; 427/391
[58] Field of Search ..... 427/362, 391

[56] References Cited

U.S. PATENT DOCUMENTS 4,620,992 11/1986 Nojima et al. ..... 427/362
4,686,119 8/1987 Nojima et al. ..... 427/362
5,043,190 8/1991 Katsumata et al. ..... 427/362

*Primary Examiner*—Michael Lusignan
*Attorney, Agent, or Firm*—Killworth, Gottman, Hagan & Schaeff

[57] ABSTRACT

The present invention provides a method of producing a cast coated paper including the steps of providing a pigment coating layer for casting on a base paper, plasticizing the coating layer by means of a rewet liquid, and drying the coating layer by pressing the coating layer against a heated metal drum having a highly polished surface such that the dried coating layer has a high gloss. The rewet liquid is an aqueous dispersion having a complex resin. The complex resin includes a copolymer resin and a colloidal silica, the copolymer resin being obtained by copolymerizing a styrene monomer and an unsaturated carboxylic ester monomer, and the colloidal silica having a mean particle diameter ranging from 0.005 μm to 0.01 μm.

6 Claims, 1 Drawing Sheet

METHOD OF PRODUCING A CAST COATED PAPER

BACKGROUND OF THE INVENTION (a) Field of the Invention

The present invention relates to a method of producing a cast coated paper. More particularly, the invention relates to a method of effectively obtaining a cast coated paper which is superior in gloss, printability, abrasion resistance and water resistance to conventional cast coated papers.

(b) Description of the Prior Art

Conventional methods of producing a printing paper having a high gloss called a cast coated paper include a wet casting method, a rewet casting method and a gel-casting method. Said wet casting method comprises a base paper being coated with a cast coating composition, the main components of which are pigments and adhesives, then said base paper being pressed against the highly polished surface of a heated drum when the coating layer is still wet so that the paper is dried and glossed. Said rewet casting method comprises a coating composition in a wet state being dried once, rewetted and plasticized by means of a rewet liquid, and then pressed against the highly polished surface of a heated drum. Said gel-casting method comprises a coating composition in a wet state being gelled and pressed against the highly polished surface of a heated drum so that the paper is dried and glossed.

All of said casting methods are the same in that the coating layer in a wet, plasticized state is pressed against the highly polished surface of a heated drum, dried thereby and removed from said heated drum so that said coating layer copies the highly polished surface of said drum. Cast coated papers thus obtained have a high gloss and surface smoothness as compared with conventional super-calendered coated papers, and ensure a superior printing effect. Therefore, said cast coated papers are used particularly as high-grade printing papers and materials of high-grade paper ware, etc.

With the improvements of the grade of printed matters, book covers, paper ware, etc., it has been demanded that the gloss should be further improved over the conventional cast papers and the water resistance and abrasion resistance should be made higher. Methods used at present as means for satisfying such quality demands include a method of making a conventional coated paper, cast coated paper, etc. into a varnished paper or a press coat by coating said coated paper, cast coated paper, etc. with a transparent resin by a printing means and a method of making said papers into a paper laminated with a plastic film of polyethylene, vinyl chloride, etc. In all of these methods, said conventional coated paper and cast coated paper are subjected to secondary treatment.

Since it is impossible to print said varnished paper, press coat or laminated paper directly with a printing ink, these papers are varnished or laminated after being printed. It is inconvenient to do so. Particularly, said laminated paper widely used is very difficult to recycle because the laminated film thereof hinders defiberization and furthermore there is an excessive burden in the recycling process. Thus the laminated paper has many disadvantages in terms of the environmental problem, etc. over the conventional coated paper and cast coated paper.

It is an object of the present invention to obtain a cast coated paper good enough to be used in place of said varnished paper, press coat and laminated paper.

It is another object of the invention to obtain a cast coated paper having a gloss, ink gloss, abrasion resistance, water resistance etc. much better than those of said varnished paper.

Discussion will now be made as to what improvements can be made on the present technical level in an attempt to obtain a cast coated paper having high qualities comparable to those of said varnished paper, etc.

The composition of a conventional cast coating layer comprises a coating pigment and an adhesive generally used in the field of coated papers for printing, said pigment normally being used in an amount of 100 parts by weight per 5 to 50 parts by weight of said adhesive. Since the main component of said coating layer is the coating pigment, the cast coated paper obtained is superior in the absorption and retention of printing ink but much inferior in gloss, ink gloss, abrasion resistance and water resistance to said varnished paper, press coat and laminated paper.

It is possible to improve the gloss and ink gloss of a cast coated paper to some extent by increasing the amount of the adhesive in the cast coating composition. If the amount of the adhesive is increased, however, the porosity of the coating layer is lost, and the vapor permeability of said layer and the releasability from the polished drum is reduced. This will make the production speed mu(:h lower and extremely deteriorate the high printability, particularly ink set and ink drying, which is a characteristic feature of the cast coated paper.

It may seem possible to add a known release agent to the coating composition or increase the amount of the pigment in order to improve said releasability. However, the addition of the release agent alone cannot improve the releasability to a satisfactory level. If the pigment is added to such an extent as that said releasability is improved, the gloss will be reduced.

Also, it may seem possible to add a lubricant such as a polyethylene wax and a natural wax to the coating composition in order to improve the abrasion resistance of the cast coated paper. However, to obtain abrasion resistance comparable to that of said varnished paper, press coat or laminated paper, it is necessary to add said lubricant in large quantities and as a result printability such as ink set and surface strength may by reduced.

The water resistance of the cast coated paper can be improved by adding a water resisting agent which has been used in the field of paper coating. However, it is difficult to obtain water resistance equal to that of said varnished paper, press coat or laminated paper.

As apparent from the above, it is very difficult to find in the present technical level a means for satisfying all of said qualities, printability and releasability of the cast coated paper . In other words, even if an improvement is made on the basis of the conventional method of producing the cast coated paper, it is very difficult to obtain gloss, ink gloss, abrasion resistance and water resistance comparable to those of said varnished paper, press coat or laminated paper.

A case is known in which an attempt was made to improve the qualities of a cast coated paper by means of a rewetting method by improving a rewet liquid used in a reset casting method. For example, Japanese Patent Publication No. Sho 48-38005 discloses cast finishing by a rewet casting method by means of a rewet liquid containing a film forming substance in an amount of 0.1 to 20% immediately before a coating layer comprising a pigment and an adhesive is pressed against the highly polished surface of a heated drum. In this method, said coating layer comprising a pigment and an adhesive is in charge of printability such as the absorption and retention of ink, and an attempt is made to improve gloss by forming a thin layer of said film forming substance on the surface of said coating layer. However, the film forming substance can be added only to such an extent that the porosity of the coating layer is not lost and it is impossible to obtain sufficient gloss.

It is possible to improve gloss by increasing the amount of said film forming substance within said rewet liquid. Since in this case a thick layer of said film forming substance is formed on the surface of the pigment in the coating layer, the absorption of ink by the pigment is hindered and ink set is reduced. Since vapor permeability is reduced, releasability is also deteriorated. To obtain satisfactory printability and releasability on these conditions, the film forming substance itself must be excellent in the absorption, retention, etc. of ink and releasability. However, the film forming substance shown in said publication does not satisfy these requirements.

SUMMARY OF THE INVENTION

The present invention obtains a cast coated paper having gloss comparable to that of said varnished paper, press coat or laminated paper, as well as excellent printability, abrasion resistance, water resistance and releasability. The present invention obtains a novel cast coated paper by a method which is rather close to the rewet casting method among the methods of producing cast coated paper.

The method of producing a cast coated paper according to the present invention comprises a pigment coating composition for casting being applied onto a base paper and dried, said coating composition being a normal mixture, the coating layer preferably being adapted to have a smoothness of above 50 seconds in accordance with JIS P8119, the surface of the pigment coating layer being plasticized by means of a rewet liquid having a component as in the following, then said coating layer being pressed against a cast drum surface for specular finish (cast finish). Said rewet liquid is an aqueous dispersion, the main component of which is a complex resin comprising a copolymer resin and a colloidal silica, said copolymer resin being obtained by copolymerizing a styrene monomer and/or an unsaturated carboxylic ester monomer, said colloidal silica having a mean particle diameter of 0.005 to 0.1 μm, preferably 0.01 to 0.05 μm.

In the present invention as mentioned above, said rewet liquid is used, the main component thereof being a complex resin comprising a copolymerized resin and a colloidal silica having a specific mean particle diameter, said rewet liquid being applied onto the surface of the dried coating layer for casting to plasticize said coating layer, then said coating layer being adapted to have a high gloss I)y being pressed against the highly polished surface of a heated drum. This method makes it possible to obtain a gloss comparable to that of the conventional varnished paper, press coat or laminated paper, and also to remarkably increase the efficiency of producing the cast coated paper.

The technical reason why said desired effects are obtained by the above-mentioned means is not necessarily clear, but the reason is assumed to be as follows: Generally speaking, to obtain an excellent appearance of a cast coated paper, it is important that two requirements contradictory to each other are satisfied when a coating layer in a wet plasticized state is pressed against the highly polished surface of a heated drum, one being that said wet coating layer closely contacts the drum surface with a suitable adhesion so that said coating layer faithfully copies the drum surface, the other being that said coating layer after being dried easily separates from the drum surface. Said complex resin used in the present invention forms a uniform coating film on the cast coating layer, the copolymer component within said complex resin in a wet state giving a suitable adhesion between the coating layer and the highly polished surface of the heated drum. In course of the drying process, the adhesion between the coating layer and the drum surface is rapidly reduced and the coating layer is easily separated from the drum surface because the hydroxyl group of the colloidal silica is strongly combined mutually with the colloidal silica or with an adhesive ingredient within said cast coating layer through dehydration and condensation. The above would give the cast coated paper an excellent appearance with respect to gloss, pin holes, uneven gloss, etc. as well as excellent releasability. The cast coated paper would have excellent abrasion resistance and water resistance because said complex resin comprising said monomer resin and colloidal silica forms a strong film on the surface of the cast coated paper.

Since said complex resin has a high affinity for ink, ink set would be improved. Also, since the amount of vehicle within ink permeating into the cast coating layer is small, the cast coated paper would have (excellent ink gloss.

Said resin obtained by copolymerizing a styrene monomer and/or an unsaturated carboxylic ester monomer and said monomers as well as said colloidal silica will be explained in detail below.

Said unsaturated carboxylic ester monomer which is an indispensable component of the present invention may be acrylic ester or methacrylic ester in which the alkyl group has 1 to 18 carbons. To be concrete, said unsaturated carboxylic ester monomer may be any of the following: acrylic ester monomers such as methyl acrylate, ethyl acrylate, butyl acrylate, 2-ethyl hexyl acrylate, lauryl acrylate, 2-hydroxyethyl acrylate and glycidyl acrylate, and methacrylic ester monomers such as methyl methacrylate, ethyl methacrylate, 2-hydroxyethyl methacrylate, 2-hydroxy propyl methacrylate and glycidyl methacrylate. These monomers are used in an amount of 100 to 30% by weight of the total resin content.

In addition to the unsaturated carboxylic monomer copolymer, a copolymer comprising a styrene monomer and an unsaturated carboxylic monomer is also used in the present invention. Said styrene monomer used in the present invention may be, for example, any of styrene, α-methyl styrene and vinyl toluene. Among them, styrene is often used. It is desirable that these monomers are used in an amount of 0 to 70% by weight, preferably 0 to 40% by weight of the total resin content.

It is also possible to use the following copolymers with these monomers: vinyl cyanide monomers such as acrylonitrile and methacrylonitrile; ethylene unsaturated carboxylic amides such as acrylic amide, methacrylic amide, N-methylol acrylic amide and N-methylol methacrylic amide; or monomers such as vinyl chloride, vinylidene chloride, vinyl acetate, vinyl propionate, ethyrene and butadiene.

The copolymer component used in the present invention may be obtained by copolymerizing said monomers or may be a substitution derivative of the copolymer. The substitution derivative may be carboxylated or made alkali active.

The resin component of the copolymer resin forming a complex with the colloidal silica may be, for example, any of the following: styrene-acrylic ester copolymer resin, styrene-methacrylic ester-acrylic ester, copolymer resin and methacrylic ester-acrylic ester copolymer resin. These acrylic resins give excellent printability. In view of releasability, it is desirable that these copolymers have a glass transition temperature (Tg) of above −30° C., preferably above −20° C. Monomers forming said copolymers may be optionally selected according to the glass transition temperature (Tg) of the copolymers obtained and the desired printability.

As a result of experiments, the inventors have found that said resins alone can not gi.,e desired effects and it is very important that the resin obtained by polymerizing said monomers under the existence of the colloidal silica by a conventional emulsion polymerization method forms a complex such as Si-O-R (R: resin) with the colloidal silica. Only when a complex resin obtained by combining said specific copolymer resin and colloidal silica is used, it is possible to obtain excellent gloss, ink set, abrasion resistance, water resistance, etc. it is impossible to obtain them where said copolymer resin and aqueous colloidal silica dispersed in water are simply dispersed and mixed together.

The particle diameter of the colloidal silica should be taken into consideration because the quality of a cast coated paper obtained depends upon the particle diameter of the colloidal silica used. If the mean particle diameter of the colloidal silica is below 0.005 μm, printability such as ink set may be reduced. If the mean particle diameter of the colloidal silica is above 0.1 μm, gloss may be much reduced and surface strength may be reduced.

It is desirable that the resin and colloidal silica forming said complex resin are in a ratio of 100:30 to 100:300, preferably 100:40 to 100:200. If the amount of the colloidal silica is below 30 parts by weight or above 300 parts by weight per 100 parts by weight of the resin, this is not desirable because releasability may be reduced.

In the present invention as mentioned above, a rewet liquid mainly comprising a complex of said copolymer and colloidal silica is applied onto the surface of a pigment coating layer once dried to plasticize and cast said coating layer, thereby said desired effects being obtained.

The percentage of the resin mainly comprising a complex of said copolymer and colloidal silica to the rewet liquid is adjusted to be in a range of 0.1 to 45% by weight, preferably 0.5 to 25% be weight.

It is desirable that the composition of the rewet liquid in the present invention contains, besides said complex resin, an aqueous colloidal silica having a mean particle diameter of 0.005 to 0.1 μm as a pigment component. In this case, printability such as ink set and releasability are remarkably improved. If the mean particle diameter of the aqueous colloidal silica dispersible in water is below 0.005 μm, releasability is not improved very much. If the mean particle diameter of the aqueous colloidal silica is above 0.1 μm, gloss and ink gloss are reduced. If the mean particle diameter of the aqueous colloidal silica is below 0.005 μm or above 0.1 μm, there is a further disadvantage that printability, abrasion resistance, water resistance, etc. are reduced.

It is desirable that the aqueous colloidal silica dispersed in water is added in a ratio of 10 to 200 parts by weight, preferably 30 to 150 parts by weight per 100 parts by weight of said complex resin. If the ratio of the aqueous colloidal silica is below 10 parts by weight, it is difficult to obtain the desired effects. If the ratio of the aqueous colloidal silica is above 200 parts by weight, gloss is liable to be reduced.

To ensure the releasability at the time of casting, it is possible in the method of the present invention to use a release agent along with said complex which is the main component of the rewet liquid. The release agent may be, for example, any of the following: fatty acids such as stearic acid, oleic acid and palmitic acid; salts thereof such as calcium, zinc, sodium and ammonium: amides such as stearic acid amide, ethylene bis stearic acid amide and methylene bis stearic acid amide; hydrocarbons such as microcrystalline wax, paraffin wax and polyethylene emulsion; higher alcohols such as cetyl alcohol and stearyl alcohol; fats and fatty oils such as red oil and lecithin; surface active agents such as surface active agent containing fluorine; fluorine polymers such as poly-tetrafluoro ethylene and ethylene-tetrafluoro copolymer. The release agent is added in a ratio of 0.5 to 100 parts by weight, preferably 5 to 50 parts by weight per 100 parts by weight of said complex resin.

As a result of further study, the inventors have found that the rewet liquid may be obtained simply by mixing said various ingredients but a cast coated paper having better appearance with respect to gloss, uneven gloss and pin holes can be obtained if said rewet liquid is adapted to have a viscosity of 50 to 5000 cps, preferably 70 to 3000 cps as measured by means of a Brookfield viscometer (measured on conditions of a room temperature/60 rpm).

It is not necessarily clear why such better effects are obtained by adjusting the viscosity of the rewet liquid as mentioned above. It is assumed that when the viscosity of the rewet liquid is in said range the uneven gloss and pin holes are effectively eliminated because the surface of the cast coating layer is more uniformly plasticized.

The viscosity of the rewet liquid may be adjusted to said range by any method, for example by increasing the consistency of said complex of said copolymer and colloidal silica and the consistency of said release agent, or by mixing the rewet liquid with the following additives in a range of 0.05 to 50 parts by weight, preferably 0.1 to 25 parts by weight per 100 parts by weight of said complex resin: proteins such as casein, soybean protein and synthetic protein; starches such as starch and oxidized starch; polyvinyl alcohol, cellulose derivatives such as carboxymethyl cellulose and methyl cellulose; thickners or viscosity modifiers such as polycarboxylic acid, polyacrylic acid, acrylic emulsion, polyamide, polyester, alkaline thickner and non-ionic surface active agent; ammonium salts or metallic salts of inorganic acids or organic acids such as sodium chloride, ammonium chloride, zinc chloride, magnesium chloride, sodium sulfate, potassium sulfate, ammonium sulfate, zinc sulfate, magnesium sulfate, ferrous sulfate, sodium nitrate, ammonium nitrate, sodium phosphate, ammonium phosphate, calcium phosphate, sodium polyphosphate, sodium hexametaphosphate, sodium formate, ammonium formate, sodium acetate, potassium acetate, sodium monochloroacetate, sodium malonate, sodium tartrate, potassium tartrate, sodium citrate, potassium citrate, sodium lactate, sodium gluconate, sodium adipate and sodium dioctyl sulfosccinate; amines such as methyl amine, diethanolamine, diethylene triamine, diisopropylamine, triethanolamine and ethanolamine; or aqueous ammonia, etc.

It is possible to add the following as required to the rewet liquid: synthetic resin latexes such as styrene-butadiene latex, methylmethacrylate-butadiene latex, styrene-acrylate resin and acrylic emulsion; polyfunctional epoxy compounds for improving the water resistance and blocking resistance of the coating composition such as diglycerol polyglycidyl ether, glycerol polyglycidyl ether, polyethylene glycol diglycidyl ether, polypropylene glycol diglycidyl ether and adipic acid diglycidyl ester; zirconium compounds such as zirconium ammonium carbonate and zirconium acetate; water-resisting agents and printability improving agents such as urea-formaldehyde, melamine-formaldehyde, polyamide urea-formaldehyde, polyamideepichlorhydrine and glyoxal.

It is also possible to add pigments to the rewet liquid in such a range that the characteristics of the complex resin component of the present invention are not lost. The pigments added may be for example as follows: clay, kaolin, calcined clay, amorphous silica, aluminium hydroxide, titan oxide, barium sulfate, zinc oxide, satin white, calcium sulfate, talc, plastic pigments, and cubic, pillar-shaped, rice-shaped, spindle-shaped, ball-shaped, or amorphous precipitated calcium carbonate or ground calcium carbonate. These pigments may be added preferably in a range of 0 to 200 parts by weight per 100 parts of said resin component.

Auxiliary agents such as a dispersing agent, anti-foaming agent, coloring agent, fluorescent dye, antistatic agent and antiseptic may be added to the rewet liquid.

The pigment coating composition for casting used in the present invention is not limited and mainly comprises one or more coating pigments and one or more adhesives generally used in the production of cast coated papers. The pigments may be for example as follows: kaolin, aluminium hydroxide, satin white, barium sulfate, ground calcium carbonate, precipitated calcium carbonate, talc, plastic pigment, calcined clay, titan dioxide, etc. One or more of these pigments may be used. The adhesives may be for example as follows: proteins such as casein and soybean protein; conjugate diene polymer latexes such as styrene-butadiene copolymer and methyl methacrylate-butadiene copolymer; acrylic polymer latexes such as a polymer or copolymer of acrylic ester and/or methacrylic ester; vinyl polymer latexes such as ethylene-vinyl acetate copolymer; alkali soluble or alkali non-soluble copolymer latexes comprising said polymers being subjected to functional group denaturization by means of a monomer containing a functional group such as carboxyl group; synthetic resin adhesives such as polyvinyl alcohol, olefinmaleic acid anhydride resin and melamine resin; starches such as positive starch, oxidized starch and esterified starch: and cellulose derivatives such as carboxymethyl cellulose and hydroxyethyl cellulose. These adhesives are generally used for coated papers. One or more of these adhesives may be used in the present invention. The adhesives are used in a range of 5 to 50 parts by weight, generally 10 to 30 parts by weight per 100 parts by weight of pigments. In addition to said pigments and adhesives, auxiliary agents such as an anti-foaming agent, coloring agent, release agent, viscosity modifier, water-resisting agent and antiseptic are used as required.

The pigment coating composition for casting comprising the above-mentioned materials is adapted to have a solid matter consistency of 45 to 65% by weight, said cast coating composition being applied onto a base paper having a basis weight of about 35 to 400 g/m$^2$ and a porous film by means of a conventional coater so that the dry weight is about 5 to 50 g/m$^2$, then the coating layer being cast.

The coater may be, for example, any of the following conventional ones: blade coater, air knife coater, roll coater, brush coater, Champflex coater, bar coater, gravure coater, etc. After coating, the coated layer in a dried or half dried state is supplied with said rewet liquid and finished by are wet casting method.

When the pigment coating composition for casting has been applied onto a base paper and dried, the rewet liquid may be immediately applied thereon for plasticization. However, it is desirable to smooth the surface of the coated layer before the rewet liquid is applied so that the surface of the coated layer has a Bekk smoothness by JIS P8119 of above 50 seconds, preferably above 100 seconds. If the Bekk smoothness is below 50 seconds, the surface of the coating layer is slightly rugged and therefore the surface of the finished cast coated paper may have some pin holes and uneven gloss. The desired smoothness may be obtained by calendering the paper as required by means of a calender, super calender or brush calender. It is of course possible in the present invention to use a cast coated paper, already cast finished, as a base paper with a pigment coating composition.

The base paper used in the present invention is not limited and may be an acidic paper or a neutralized paper generally used in the field of cast coated papers. The base paper may be preliminarily coated in advance on one surface or two surfaces thereof with a usual pigment coating composition as required. The amount of coating thereof is preferably 5 to 30 g/m$^2$ (dry weight) per surface. The preliminarily coated paper may be smoothed in advance by super calendering, brushing, cast finishing, etc. as required.

DETAILED DESCRIPTION OF THE PREFERRED EMBODIMENTS

The present invention will now be described in detail with reference to examples. It is to be noted that the present invention is not limited to the examples. In the examples, "parts" or "%" (percent) means "parts" or "%" by weight, unless otherwise stated.

EXAMPLE 1

A pigment coating composition for casting comprising 70 parts kaolin, 30 parts precipitated calcium carbonate, 0.5 part sodium polyacrylate, 6 parts oxidized starch, 15 parts (solid matter) styrene-butadiene copolymer latex and 0.5 part calcium stearate was adapted to have a solid matter consistency of 64%, said pigment coating composition being applied onto a base paper having a basis weight of 100 g/m$^2$ by means of a blade coater so that the dry weight was 25 g/m$^2$. After being dried, the paper coated with said pigment coating composition was smoothed by means of a super calender so as to have a Bekk smoothness of 150 seconds.

Figure 1:
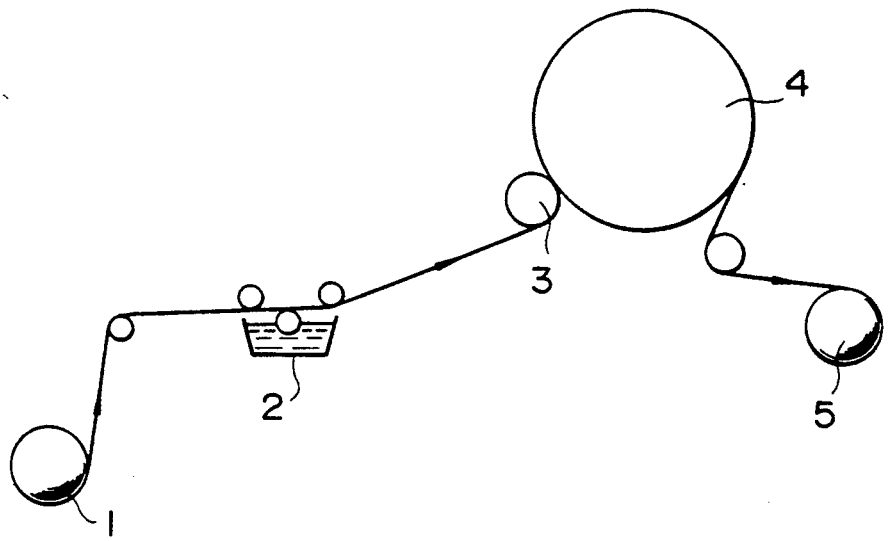
FIG. 1 schematically shows an apparatus used in the method of the present invention. In the apparatus, a pigment coating layer for casting is applied onto a base paper, dried, coated with a rewet liquid by means of a roll coater and pressed against the surface of a cast drum, thereby a cast coated paper being obtained.

A coated paper for rewet casting thus obtained was coated with a rewet liquid comprising 100 parts of a resin component A shown in Table 1, 10 parts of polyethylene wax and 2 parts of sodium polyacrylate, said rewet liquid having a solid matter consistency of 25% and a Brookfield viscosity (measured by means of a Brookfield viscometer at 60 rpm, room temperature) of 200 cps. Then, said coated paper was subjected to rewet cast finish by means of a cast coating apparatus shown in FIG. 1.

To be concrete, said paper was coated with said rewet liquid by means of a roll coater 2, immediately after that said paper being pressed against a highly polished cast drum 4 having a surface temperature of 75° C. and a diameter of 3000 mm, after being dried said paper being separated from said cast drum. Thus a cast coated paper 5 was obtained.

Table 1 shows the particle diameter of the colloidal silica in resin components (complex resins) used in Examples, the weight ratio between the copolymer and the colloidal silica, the glass transient temperature (Tg/°C.) of the copolymer and the mean particle diameter and number of parts of the aqueous colloidal silica dispersed in water added as a pigment component.

EXAMPLE 2

A cast coated paper was obtained in the same way as in Example 1 except that said resin component A in said rewet liquid of Example 1 was replaced by a resin component B shown in Table 1.

EXAMPLE 3

A cast coated paper was obtained in the same way as in Example 1 except that said resin component A in said rewet liquid of Example 1 was replaced by a resin component C shown in Table 1.

EXAMPLE 4

A cast coated paper was obtained in the same way as in Example 1 except that said resin component A in said rewet liquid of Example 1 was replaced by a resin component D shown in Table 1.

EXAMPLE 5

A cast coated paper was obtained in the same way as in Example 1 except that said resin component A in said rewet liquid of Example 1 was replaced by a resin component E shown in Table 1.

EXAMPLE 6

A cast coated paper was obtained in the same way as in Example 1 except that said resin component A in said rewet liquid of Example 1 was replaced by a resin component F shown in Table 1.

EXAMPLE 7

A cast coated paper was obtained in the same way as in Example 1 except that said resin component A in said rewet liquid of Example 1 was replaced by a resin component G shown in Table 1.

EXAMPLE 8

A cast coated paper was obtained in the same way as in Example 1 except that said resin component A in said rewet liquid of Example 1 was replaced by a resin component H shown in Table 1.

EXAMPLE 9

A cast coated paper was obtained in the same way as in Example 1 except that said resin component A in said rewet liquid of Example 1 was replaced by x resin component I shown in Table 1.

EXAMPLE 10

A cast coated paper was obtained in the same way as in Example 1 except that said resin component A in said rewet liquid of Example 1 was replaced by a resin component J shown in Table 1.

EXAMPLE 11

A cast coated paper was obtained in the same way as in Example 1 except that said resin component A in said rewet liquid of Example 1 was replaced by a resin component K shown in Table 1.

EXAMPLE 12

A cast coated paper was obtained in the same way as in Example 1 except that said resin component A in said rewet liquid of Example 1 was replaced by a resin component L shown in Table 1.

EXAMPLE 13

A cast coated paper was obtained in the same way as in Example 1 except that said resin component A in said rewet liquid of Example 1 was replaced by t resin component M shown in Table 1.

EXAMPLE 14

A cast coated paper was obtained in the same way as in Example 1 except that said resin component A in said rewet liquid of Example 1 was replaced by a mixture B1 shown in Table 1, said mixture B1 comprising 100 parts resin component B and 200 parts aqueous colloidal silica dispersed in water having a mean particle diameter of 0.02 μm.

EXAMPLE 15

A cast coated paper was obtained in the same way as in Example 1 except that said resin component A in said rewet liquid of Example 1 was replaced by a mixture $B_2$ shown in Table 1, said mixture $B_2$ comprising 100 parts resin component B and 150 parts aqueous colloidal silica dispersed in water having a mean particle diameter of 0.02 μm.

EXAMPLE 16

A cast coated paper was obtained in the same way as in Example 1 except that said resin component A in said rewet liquid of Example 1 was replaced by a mixture B3 shown in Table 1, said mixture B3 comprising 100 parts resin component B and 100 parts aqueous colloidal silica dispersed in water having a mean particle diameter of 0.004 μm.

EXAMPLE 17

A cast coated paper was obtained in the same way as in Example 1 except that said resin component A in said rewet liquid of Example 1 was replaced by a mixture B4 shown in Table 1, said mixture B4 comprising 100 parts resin component B and 100 parts aqueous colloidal silica dispersed in water having a mean particle diameter of 0.15 μm.

EXAMPLE 18

A cast coated paper was obtained in the same way as in Example 1 except that said resin component A in said rewet liquid of Example 1 was replaced by a mixture B5 shown in Table 1, said mixture B5 comprising 100 parts resin component B and 250 parts aqueous colloidal silica dispersed in water having a mean particle diameter of 0.02 μm.

EXAMPLE 19

A cast coated paper was obtained in the same way as in Example 1 except that said resin component A in said rewet liquid of Example 1 was replaced by i mixture $B_6$ shown in Table 1, said mixture $B_6$ comprising 100 parts resin component B and 5 parts aqueous colloidal silica dispersed in water having a mean particle diameter of 0.02 μm.

EXAMPLE 20

A pigment coating composition for casting comprising 40 parts kaolin, 60 parts ground calcium carbonate, 0.5 part sodium polyacrylate, 7 parts oxidized starch, 10 parts styrene-butadiene copolymer latex and 0.5 part zirconium ammonium carbonate was adapted to have a solid matter consistency of 64% said pigment coating composition being applied onto a base paper having a basis weight of 100 g/m$^2$ by means of a blade coater so that the dry weight was 10 g/m$^2$, then said pigment coating composition being dried. A coated paper for rewet casting thus obtained had a Bekk smoothness of 40 seconds.

A cast coated paper was obtained by applying said rewet liquid used in Example 2 onto he coated paper prepared above by the same method as in Example 1.

EXAMPLE 21

A pigment coating composition for casting comprising 60 parts kaolin, 40 parts precipitated calcium carbonate, 5 parts casein, 15 parts styrene-butadiene copolymer latex and 0.5 part epoxy water resisting agent was adapted to have a solid matter consistency of 45% said pigment coating composition being applied onto a base paper having a basis weight of 100 g/m$^2$ by means of an air knife coater so that the dry weight was 25 g/m$^2$. After being dried, the paper coated with said pigment coating composition was smoothed by means of a super calender so as to have a Bekk smoothness of 250 seconds. Thus a coated paper for rewet casting was obtained.

A cast coated paper was obtained by applying said rewet liquid used in Example 2 onto the coated paper prepared above by the same method as in Example 1.

COMPARATIVE EXAMPLE 1

A cast coated paper was obtained in the same way as in Example 1 except that said resin component A in said rewet liquid of Example 1 was replaced by a resin component N shown in Table 1.

COMPARATIVE EXAMPLE 2

A cast coated paper was obtained in the same way as in Example 1 except that said resin component A in said rewet liquid of Example 1 was replaced by a resin component O shown in Table 1.

COMPARATIVE EXAMPLE 3

A cast coated paper was obtained in the same way as in Example 1 except that said resin component A in said rewet liquid of Example 1 was replaced by a resin component P shown in Table 1.

COMPARATIVE EXAMPLE 4

A cast coated paper was obtained in the same way as in Example 1 except that said resin component A in said rewet liquid of Example 1 was replaced by a mixture N1 shown in Table 1, said mixture N1 comprising 100 parts resin component N and 100 parts aqueous colloidal silica dispersed in water having a mean particle diameter of 0.02 μm.

The gloss, uneven gloss, pin holes, ink gloss, ink mottling, ink set, abrasion resistance and water resistance of the cast coated papers thus obtained in Examples 1 to 21 and Comparative Examples 1 to 4 were evaluated as shown in Table 2. Also the speed of cast coating of each of said papers is shown in Table 2.

EXAMPLES 22 to 29 and COMPARATIVE EXAMPLES 5 to 8

Figure 2:
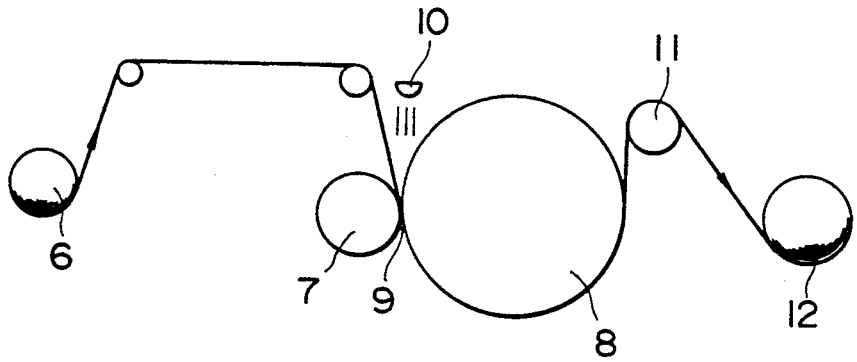
FIG. 2 schematically shows an apparatus in which said pigment coating layer is sprayed with a rewet liquid through a nozzle for plasticization, then said pigment coating layer being pressed against the surface of a cast drum, thereby a cast coated paper being obtained.

A pigment coating composition for casting comprising 70 parts kaolin, 30 parts precipitated calcium carbonate, 0.5 part sodium polyacrylate, 1.0 part calcium stearate, 10 parts (solid matter) casein dissolved with ammonia and 16 parts (solid matter) styrene-butadiene copolymer latex was adapted to have a solid matter consistency of 45%. said pigment coating composition being applied onto a base paper having a basis weight of 100 g/m$^2$ by means of an air knife coater so that the dry weight was 25 g/m$^2$, then said pigment coaling composition being dried. A coated paper for rewet casting thus obtained was subjected to rewet cast finish by means oil an apparatus shown in FIG. 2 as follows:

Said coated paper 6 was passed through a press nip 9 formed by a press roll 7 and a cast drum 8. At the nip 9, the surface of the coated layer of the coated paper 6 was rewetted with a rewet liquid having components shown in Table 3, said rewet liquid being supplied from a nozzle 10. Then the coated paper 6 was pressed against the cast drum 8 having a temperature of 95° C. at a linear pressure of 150 kg/cm and dried thereby. Now the paper 6 was removed from the cast drum 8 by a take-off roll 11. Thus a rewet cast coated paper 12 was obtained.

EXAMPLES 30 to 36 and COMPARATIVE EXAMPLE 9

A pigment coating composition for casting comprising 70 parts kaolin, 30 parts precipitated calcium carbonate, 0.5 part sodium polyacrylate, 6 parts (oxidized starch, 15 parts styrene-butadiene copolymer latex and 1.0 part calcium stearate was adapted to have a solid matter consistency of 64%, said pigment coating composition being applied onto a base paper having a basis weight of 100 g/m$^2$ by means of a blade coater so that the dry weight was 25 g/m$^2$, then said pigment coating composition being dried. A coated paper for rewet casting thus obtained was rewetted with a rewet liquid having components shown in Table 4 by the same method as in Examples 22 to 29 and then subjected to rewet cast finish.

The gloss, uneven gloss, pin holes, ink gloss, ink mottling, ink set, abrasion resistance and water resistance of the cast coated papers thus obtained in Examples 22 to 36 and Comparative Examples 5 to 9 were evaluated as shown in Table 5. Also the speed of cast coating of each of said papers is shown in Table 5.

The quality evaluations of said cast coated papers were made as in the following:

Gloss

Gloss was measured in accordance with JIS-P-8142.

Uneven Gloss

Uneven gloss on the surface of each cast coated paper was visually measured. The results of the visual measurements are represented in Tables 2 and 5 by the following relative valuations:

| | |
|---|---|
| ◎: | No uneven gloss was found. |
| ○: | Slight uneven gloss was found but there was no problem in practice. |
| Δ: | Uneven gloss was found. |
| X: | Much uneven gloss was found. |

Pin Holes

The surface of each cast coated paper was observed by means of a microscope. The existence of pin holes is represented in Tables 2 and 5 by following relative valuations:

| | |
|---|---|
| ○: | Less than 10 pin holes were found per 1 $cm^2$. |
| Δ: | 10 to 50 pin holes were found per 1 $cm^2$. |
| X: | More than 50 pin holes were found per 1 $cm^2$. |

Ink Gloss

The surface of each cast coated paper was printed with 0.3 ml of a sheet offset ink ("F-Gloss" made by Dainippon Ink And Chemicals, Incorporated) by means of a printing tester ("RI-1" made by Akira Seisakusho Co., Ltd.), and the paper was let alone at a room temperature for a whole day and night. Then, the gloss at 60° of the printed surface was measured by means of a gloss meter made by Murakami Color Research Laboratory.

Ink Mottling

The surface of each cast coated paper was printed with 0.1 ml of said sheet offset printing ink ("F-Gloss" made by Dainippon Ink And Chemicals, Incorporated) by means of a printing tester ("RI-1" made by Akira Soisakusho Co., Ltd.), and the paper was let alone at a room temperature for a whole day and night. The ink mottling on the printed surface was visually measured. The results of the visual measurements are represented in Tables 2 and 5 by the following relative valuations:

| | |
|---|---|
| ○: | No ink mottling was found. |
| Δ: | Ink mottling was found. |
| X: | Serious ink mottling was found. |

Ink Set

The surface of each cast coated paper was printed with 0.6 ml of said sheet offset printing ink ("F-Gloss" made by Dainippon Ink And Chemicals, Incorporated) by means of a printing tester ("RI-1" made by Akira Seisakusho Co., Ltd.). Immediately after printing and 10 minutes after printing, a wood free paper was placed upon each cast coated paper, and these papers were pressed together with a certain pressure. The density of ink transferred to the surface of the wood free paper was visually measured. The results of the visual measurements are represented in Tables 2 and 5 by the following relative valuations:

| | |
|---|---|
| ◎: | 10 minutes after printing, almost no ink was transferred. |
| ○: | The density of ink transferred 10 minutes after printing was about half of the density of ink transferred immediately after printing. There was no problem in practice. |
| Δ: | The density of ink transferred 10 minutes after printing was a little lower than the density of ink transferred immediately after printing. |
| X: | There was almost no difference between the density of ink transferred immediately after printing and the density of ink transferred 10 minutes after printing. |

Abrasion Resistance

The surface of each cast coated paper was printed with 0.3 ml of said sheet offset printing ink ("F-Gloss" made by Dainippon Ink And Chemicals, Incorporated) by means of a printing tester ("RI-1" made by Akira Seisakusho Co., Ltd.) and the paper was let alone at a room temperature for a whole day and night. The printed surface and the non-printed surface were rubbed together 20 times under a load of 1.8 kg by means of a Sutherland Tester. Scratches and stains on the printed surface and the non-printed surface were visually measured. The results of the visual measurements are represented in Tables 2 and 5 by the following relative valuations:

| | |
|---|---|
| ○: | Almost no scratches or stains were found. |
| Δ: | Scratches and stains were found. There was no problem in practice. |
| X: | Serious scratches and stains were found. |

Water Resistance

Two pieces of each cast coated paper were place one upon the other so that the coated surface thereof is in contact with each other. These pieces of paper were let alone for 24 hours at 40° C. and 90% RH under a load of 500 g/$cm^2$. The state of the coated surface of each cast coated paper was inspected. The results of the inspection are represented in Tables 2 and by the following relative valuations:

| | |
|---|---|
| ○: | The coated surfaces of the paper did not stick to each other at all. |
| Δ: | The coated surfaces of the paper slightly stuck to each other. |
| X: | The coated surfaces of the paper seriously stuck to each other. |

Maximum Production Speed

Tables 2 and 5 further show a maximum production speed (meter/minute) of each cast coated paper produced by the method described above, which speed ensures stable production free from the sticking of the cast coated paper to the cast drum as well as from drum pick and drum blistering.

TABLE 1

| Resin Component (See notes below.) | Celloidal silica Average particle diameter (μm) | Weight ratio between copolymer resin and colloidal silica | Tg of copolymer resin (°C.) | Aqueous colloidal silica Mean particle diameter | Aqueous colloidal silica Number of parts |
|---|---|---|---|---|---|
| A | 0.02 | 100:100 | −15 | | |
| B | 0.02 | 100:100 | −20 | | |
| C | 0.02 | 100:100 | −15 | | |
| D | 0.02 | 100:100 | −5 | | |
| E | 0.02 | 100:40 | −20 | | |
| F | 0.02 | 100:250 | −20 | | |
| G | 0.01 | 100:100 | −15 | | |
| H | 0.05 | 100:100 | −15 | | |
| I | 0.02 | 100:350 | −20 | | |
| J | 0.02 | 100:20 | −20 | | |
| K | 0.004 | 100:100 | −15 | | |
| L | 0.15 | 100:100 | −15 | | |
| M | 0.02 | 100:150 | −20 | | |
| B1 | 0.02 | 100:100 | −20 | 0.02 | 20 |
| B2 | 0.02 | 100:100 | −20 | 0.02 | 150 |
| B3 | 0.02 | 100:100 | −20 | 0.004 | 100 |
| B4 | 0.02 | 100:100 | −20 | 0.15 | 100 |
| B5 | 0.02 | 100:100 | −20 | 0.02 | 250 |
| B6 | 0.02 | 100:100 | −20 | 0.02 | 5 |
| N | — | 100:0 | −15 | — | — |
| O | — | 100:0 | 38 | — | — |
| P | — | 100:0 | — | — | — |
| N1 | — | 100:0 | −15 | 0.02 | 100 |

Notes to Table 1

A Complex of styrene-butyl acrylate copolymer and colloidal silica

B. Complex of styrene-methyl methacrylate-2-ethyl hexyl acrylate copolymer and colloidal silica C: Complex of styrene-2-ethyl hexly acrylate copolymer and colloidal silica D: Complex of methyl methacrylate-2-ethyl hexyl acrylate copolymer and colloidal silica E: Complex of styrene-methyl methacrylate-2-ethyl hexyl acrylate copolymer and colloidal silica F: Complex of styrene-methyl methacrylate-2-ethyl hexyl acrylate copolymer and colloidal silica G: Complex of styrene-butyl acrylate copolymer and colloidal silica H: Complex of styrene-butyl acrylate copolymer and colloidal silica I: Complex of styrene-methyl methacrylate-2-ethyl hexyl acrylate copolymer and colloidal silica J: Complex of styrene-methyl methacrylate-2-ethyl hexyl acrylate copolymer and colloidal silica K: Complex of styrene-butyl acrylate copolymer and colloidal silica L: Complex of styrene-butyl acrylate copolymer and colloidal silica M: Complex of styrene-methylmethacrylate-2-ethyl hexyl acrylate copolymer and colloidal silica B1: Complex of styrene-methyl methacrylate-2-ethyl hexyl acrylate copolymer and colloidal silica B2: Complex of styrene-methyl methacrylate-2-ethyl hexyl acrylate copolymer and colloidal silica B3: Complex of styrene-methyl methacrylate-2-ethyl hexyl acrylate copolymer and colloidal silica B4: Complex of styrene-methyl methacrylate-2-ethyl hexyl acrylate copolymer and colloidal silica B5: Complex of styrene-methyl methacrylate-2-ethyl hexyl acrylate copolymer and colloidal silica B6: Complex of styrene-methyl methacrylate-2-ethyl hexyl acrylate copolymer and colloidal silica N: Styrene-butyl acrylate copolymer O: Methyl methacrylate-2-ethyl hexyl acrylate copolymer P: Casein N1: Styrene-butyl acrylate copolymer

TABLE 2

| | Gloss | Uneven gloss | Pin holes | Ink gloss | Ink mottling | Ink set | Abrasion resistance | Water resistance | Maximum production speed |
|---|---|---|---|---|---|---|---|---|---|
| Example 1 | 95 | ◎ | ○ | 97 | ○ | ○ | ○ | ○ | 30 |
| 2 | 96 | ◎ | ○ | 92 | ○ | ○ | ○ | ○ | 30 |
| 3 | 96 | ◎ | ○ | 90 | ○ | ○ | ○ | ○ | 30 |
| 4 | 95 | ◎ | ○ | 92 | ○ | ○ | ○ | ○ | 30 |
| 5 | 96 | ◎ | ○ | 93 | ○ | ○ | ○ | ○ | 25 |
| 6 | 95 | ◎ | ○ | 94 | ○ | ○ | ○ | ○ | 30 |
| 7 | 95 | ◎ | ○ | 97 | ○ | ○ | ○ | ○ | 30 |
| 8 | 94 | ◎ | ○ | 98 | ○ | ○ | ○ | ○ | 30 |
| 9 | 93 | ◎ | ○ | 85 | ○ | ◎ | ○ | ○ | 20 |
| 10 | 95 | ◎ | ○ | 91 | ○ | ○ | Δ | ○ | 10 |
| 11 | 96 | ◎ | ○ | 95 | ○ | Δ | Δ | Δ | 20 |
| 12 | 92 | ◎ | ○ | 87 | ○ | Δ | Δ | Δ | 20 |
| 13 | 96 | ◎ | ○ | 94 | ○ | ○ | ○ | ○ | 30 |
| 14 | 96 | ◎ | ○ | 93 | ○ | ◎ | ○ | ○ | 35 |

TABLE 2-continued

| | Gloss | Uneven gloss | Pin holes | Ink gloss | Ink mottling | Ink set | Abrasion resistance | Water resistance | Maximum production speed |
|---|---|---|---|---|---|---|---|---|---|
| 15 | 94 | ◎ | ○ | 90 | ○ | ◎ | ○ | ○ | 40 |
| 16 | 95 | ◎ | ○ | 88 | ○ | ◎ | ○ | ○ | 30 |
| 17 | 90 | ◎ | ○ | 80 | ○ | ◎ | Δ | Δ | 35 |
| 18 | 90 | ◎ | ○ | 83 | ○ | ◎ | Δ | Δ | 40 |
| 19 | 96 | ◎ | ○ | 92 | ○ | ○ | ○ | ○ | 30 |
| 20 | 80 | Δ | Δ | 87 | ○ | ○ | ○ | ○ | 30 |
| 21 | 96 | ◎ | ○ | 92 | ○ | ○ | ○ | ○ | 30 |
| Comp. 1 | 89 | ◎ | ○ | 95 | Δ | X | X | X | 5 |
| example 2 | 93 | ◎ | ○ | 98 | Δ | X | Δ | Δ | 5 |
| 3 | 97 | ◎ | ○ | 100 | X | X | X | X | 30 |
| 4 | 95 | ◎ | ○ | 92 | Δ | X | X | X | 5 |

TABLE 3

| | Composition of rewet liquid | | | | | Viscosity |
|---|---|---|---|---|---|---|
| | Resin component | Release agent and other component | | | | (cps) |
| Example 22 | A 10% | Calcium stearate | 2% | | | 10 |
| 23 | G 10% | Calcium stearate | 2%, | casein | 5% | 700 |
| 24 | H 10% | Calcium stearate | 2%, | casein | 5% | 700 |
| 25 | D 10% | Ammonium stearate | 2%, | acrylic emulsion | 3% | 1000 |
| 26 | M 25% | Zink stearate | 5%, | sodium hexametaphosphate | 1% | 3000 |
| 27 | A 10% | Calcium stearate | 2%, | sodium hexametaphosphate | 1% | 500 |
| 28 | K 10% | Calcium stearate | 2%, | sodium hexametaphosphate | 1% | 500 |
| 29 | L 10% | Calcium stearate | 2%, | sodium hexametaphosphate | 1% | 500 |
| Comp. 5 | N 10% | Calcium stearate | 2%, | sodium hexametaphosphate | 1% | 500 |
| Example 6 | O 10% | Calcium stearate | 2%, | sodium hexametaphosphate | 1% | 500 |
| 7 | P 10% | Ammonium stearate | 2% | | | 30 |
| 8 | — | Polyethylene emulsion | 2% | | | 10 |

TABLE 4

| | Composition of rewet liquid | | | | | Viscosity |
|---|---|---|---|---|---|---|
| | Resin component | Release agent and other component | | | | (cps) |
| Example 30 | M 15% | Polyethylene emulsion | 2%, | carboxymethyl cellulose | 1% | 500 |
| 31 | E 15% | Zink stearate | 2%, | polyvinyl alcohol | 2% | 600 |
| 32 | F 15% | Zink stearate | 2%, | polyvinyl alcohol | 2% | 600 |
| 33 | C 20% | Ammonium oleate | 2%, | sodium polyacrylate | 3% | 4000 |
| 34 | I 15% | Ammonium oleate | 2%, | sodium polyacrylate | 2% | 1500 |
| 35 | E 15% | Ammonium oleate | 2%, | sodium polyacrylate | 2% | 1500 |
| 36 | C 25% | Zink stearate | 5%, | ammonium sulfate | 1% | 7000 |
| Comp. 9 Example | — | Polyethylene emulsion | 2% | | | 10 |

TABLE 5

| | Gloss | Uneven gloss | Pin holes | Printing gloss | Ink gloss | Ink mottling | Abrasion resistance | Water resistance | Maximum production speed |
|---|---|---|---|---|---|---|---|---|---|
| Example 22 | 94 | ○ | Δ | 95 | ○ | ○ | ○ | ○ | 65 |
| 23 | 97 | ◎ | ○ | 97 | ○ | ○ | ○ | ○ | 70 |
| 24 | 96 | ◎ | ○ | 98 | ○ | ○ | ○ | ○ | 70 |
| 25 | 96 | ◎ | ○ | 93 | ○ | ◎ | ○ | ○ | 65 |
| 26 | 95 | ◎ | ○ | 95 | ○ | ◎ | ○ | ○ | 70 |
| 27 | 97 | ◎ | ○ | 94 | ○ | ○ | ○ | ○ | 65 |
| 28 | 96 | ◎ | ○ | 95 | ○ | Δ | Δ | Δ | 65 |
| 29 | 90 | ○ | ○ | 85 | ○ | ○ | Δ | Δ | 70 |
| Comp. 5 | 88 | Δ | X | 85 | Δ | Δ | X | X | 45 |
| Example 6 | 95 | X | X | 97 | Δ | X | Δ | Δ | 20 |
| 7 | 94 | ○ | ○ | 98 | X | X | X | X | 65 |
| 8 | 92 | Δ | Δ | 85 | ○ | ◎ | X | X | 70 |
| Example 30 | 96 | ◎ | ○ | 93 | ○ | ◎ | ○ | ○ | 60 |
| 31 | 98 | ◎ | ○ | 92 | ○ | ○ | ○ | ○ | 55 |
| 32 | 97 | ◎ | ○ | 93 | ○ | ◎ | ○ | ○ | 60 |
| 33 | 98 | ◎ | ○ | 91 | ○ | ◎ | ○ | ○ | 55 |
| 34 | 91 | ◎ | ○ | 87 | ○ | ◎ | ○ | ○ | 45 |
| 35 | 97 | ◎ | ○ | 90 | ○ | Δ | ○ | ○ | 40 |
| 36 | 93 | ○ | Δ | 90 | ○ | ◎ | ○ | ○ | 50 |
| Comp. 9 Example | 70 | X | X | 75 | X | ◎ | X | X | 60 |

What is claimed is:

1. A method of producing a cast coated paper comprising the steps of:

applying a pigment coating composition onto a base paper, drying said pigment coating composition to form a pigment coating layer on said base paper including a pigment and an adhesive, plasticizing said pigment coating layer by contact with a heated rewet liquid containing effective plasticizing amounts of (1) a copolymer of styrene and an unsaturated carboxylic ester or a copolymer of unsaturated carboxylic esters and (2) colloidal silica, said colloidal silica having a mean diameter ranging from 0.005 μm to 0.1 μm; and drying said plasticized coating layer by pressing said coating layer against a heated metal drum having a highly polished surface such that said dried coating layer has a high gloss.

2. The method of claim 1 wherein said copolymer and said colloidal silica is present in said rewet liquid in a weight ratio of between 100:30 to 100:300.

3. The method of claim 1 wherein said rewet liquid further includes an aqueous colloidal silica dispersed in water and having a mean particle diameter ranging from 0.005 μm to 0.1 μm as a pigment component.

4. The method of claim 3 wherein said copolymer and said aqueous colloidal silica have a weight ratio of between 100:10 to 100:200.

5. The method of claim 1 wherein the surface of said coating layer has a Bekk smoothness of above 50 seconds.

6. The method of claim 1 wherein said rewet liquid has a viscosity of between 50 to 5000 cps.

* * * * *